US005338384A

United States Patent [19]

Reichert

[11] Patent Number: 5,338,384

[45] Date of Patent: Aug. 16, 1994

[54] METHOD AND APPARATUS FOR APPLYING SEALING TAPE TO CASES MOVING ON A CONVEYOR

[75] Inventor: Donald G. Reichert, Tarpon Springs, Fla.

[73] Assignee: ABC Packaging Machine Corporation, Tarpon Springs, Fla.

[21] Appl. No.: 67,743

[22] Filed: May 26, 1993

[51] Int. Cl.[5] ..... B31F 1/00

[52] U.S. Cl. ..... 156/212; 53/137.2; 156/216; 156/468; 156/475; 156/486

[58] Field of Search ..... 156/64, 350, 351, 361, 156/362, 363, 364, 468, 465, 486, 475, 355, 522, 200, 201, 202, 482, 212, 216; 53/137.2, 137.1, 416, 419, 139.3

[56] References Cited

U.S. PATENT DOCUMENTS 4,238,269 12/1980 Deering, Jr. ..... 156/465
5,223,075 6/1993 Sims ..... 156/468
5,227,002 7/1993 Faust et al. ..... 156/468
5,228,943 7/1993 Vasilakes ..... 156/468

*Primary Examiner*—David A. Simmons
*Assistant Examiner*—William J. Matney, Jr.
*Attorney, Agent, or Firm*—Hopkins & Thomas

[57] ABSTRACT

A tape head apparatus for applying sealing tape to cartons moving thereunder on a conveyor has rollers as part of roller assemblies for rolling the tape under pressure onto the leading face, top surface, and trailing face of the carton. The rollers, assemblies, which are carried on a support frame, and are biased toward their extended position, with the biasing force creating the pressure of the rollers on the tape and the carton. The biasing force is augmented by a pressure enhancer which is actuated while the rollers are applying the tape to the top surface, and the augmented force remains until the tape has been applied to the trailing face of the carton. A cutter cuts the tape prior to its application to the trailing face, leaving a length of unapplied tape sufficient to apply to the trailing face.

18 Claims, 3 Drawing Sheets

METHOD AND APPARATUS FOR APPLYING SEALING TAPE TO CASES MOVING ON A CONVEYOR

FIELD OF INVENTION

This invention relates to the sealing of cartons or cases and is more particularly concerned with a method and apparatus for applying sealing tape to cases moving on a conveyor.

BACKGROUND OF THE INVENTION

In a volume production milieu where large numbers of cartons or cases traveling on a conveyor are filled and sealed in sequence, it is generally the practice to use a sealing tape head near the end of the conveyor to apply tape to the cartons to seal them. The tape head, under which the cartons pass, has a tape supply and payout, a roller to press the tape onto the carton, and means for cutting the tape at the end of the sealing operation. Usually the tape applying operation commences when the leading face of the carton strikes the roller, which has sealing tape on it. As the carton moves past the tape head, the roller is cammed up the leading face of the carton, rolls along the top face or surface thereof, and rolls down the trailing face, all the while applying tape and pressing it against the carton. The cutter cuts the tape usually after it has been applied to the upper portion of the trailing face. In order for the roller to apply sufficient pressure to the tape and carton to insure a proper seal, it is generally mounted on a pivot arm which is spring biased in such a manner that the roller bears firmly against the tape and carton throughout the sealing operation.

With such an arrangement sequential sealing of moving cartons is realized. However, inasmuch as the carton is moving away from the roller while the tape is being applied to the trailing face, the spring which biases the pivot arm must be strong enough for the roller to press and maintain the tape firmly against the carton as it moves away. On the other hand, as the leading face of a carton contacts the roller, if the same spring bias is too great the roller can, and often does, dent or break the material forming the leading face of the carton thereby risking damage to the contents or destroying the integrity of the carton. Also, as tape is applied to the top of the carton, which generally comprises two flaps forming a seam to be sealed, too great a pressure by the roller can cause a separation or collapse of the flaps, thereby widening the seam and resulting in a poor seal. Some of these problems can be, and often are, alleviated by markedly decreasing the speed of the conveyor, which tends to reduce damage to the leading face by lessening the impact of the roller therewith. However, in a volume production environment, a decrease in speed results in fewer sealed cartons per unit of time, which, on a cost basis, is undesirable.

Another solution is to use cardboard or other material for the cartons which is sturdy enough to withstand the pressures brought to bear on the leading face and the top of the carton. However, this often results in the necessary use of a heavier, stronger and, hence, more expensive material for the carton than is necessary to contain and protect the goods carried therein. Thus, again, from a cost basis, this solution is undesirable.

SUMMARY OF THE INVENTION

In a preferred embodiment of the invention, the apparatus thereof comprises a tape head having a support frame which comprises a back plate and structural members extending from the lower portion of one side of the back plate and defining an open area adjacent the one side. An elongated arm is mounted to the other side of the back plate and extends upward therefrom. At the upper end of the arm is rotatably mounted a spool for holding and paying out sealing tape.

A front roller assembly comprises a first tape pressure roller rotatably supported on a support arm which is pivotally mounted to the back plate near the front end thereof. A rear roller assembly comprises a second tape pressure roller which is rotatably supported on a support arm which is pivotally mounted to the back plate near the rear end thereof. A connecting arm is connected between the front and rear roller assemblies so that movement of one roller assembly causes movement in unison of the other roller assembly. Spring biasing means supplies a biasing force to one roller assembly and through the connecting arm, to the other roller assembly to bias them in an extended position below the open area defined by the structural members. As a consequence, when a moving carton contacts and moves against the spring biased front roller assembly, the front roller, which has sealing tape riding thereon, rolls up the front or leading face of the carton, maintaining pressure, and applying tape thereto, and, at the same time, the rear roller assembly also moves up. As the carton continues to move beneath the tape head the front roller, now in a retracted position, applies tape to the top surface of the carton and the rear roller, also in its retracted position, further presses the tape onto the carton, insuring a proper seal. The biasing spring is strong enough to insure that the rollers remain in firm contact with the carton, but is not of sufficient strength to cause damage to the carton through the exertion of too great a pressure thereon.

As the top surface of the carton passes beyond the rear roller, the biasing force causes the roller to roll down the rear face of the carton. However, the biasing force on the rear roller is not great enough to guarantee firm contact with the rear or trailing face in every case. To insure adequate pressure of the rear roller on the rear face, a fluid actuated cylinder and piston assembly is connected to the rear roller assembly at substantially the same point as the biasing spring, and to the back plate. An actuating lever pivotally mounted on the back plate is adapted to be contacted by the moving carton and forced up, whereupon it actuates and opens a valve which supplies fluid under pressure to the cylinder. The piston is thereby caused to move in a direction to augment the biasing force of the spring and thus increase the pressure on the rollers as they roll along at least a portion of the top surface of the carton, and on the rear roller as it travels down the trailing face in firm contact therewith.

A tape cutter assembly is also pivotally mounted on the back plate and includes a follower arm or finger adapted to be contacted by the front face of the moving carton. The cutter assembly, which is spring biased in an extended position, is moved toward and into a retracted position as the follower arm moves up the front or leading face of the carton, and then along the top thereof. As the trailing end of the top surface of the carton moves past the follower arm, the cutter is forced down by its biasing spring and cuts the tape between the front and rear rollers. Also, as the trailing end of the top surface moves past the valve actuating lever, the lever drops down, thereby closing the valve and cutting off the fluid supply to the cylinder and piston assembly and allowing the pressure fluid in the cylinder to bleed off rapidly. The valve may be a two way valve which, when the actuating level drops down, momentarily supplies fluid under pressure to the cylinder to actuate the piston in a direction opposite to the spring bias enhancing direction.

Accordingly, it is an object of the present invention to provide an apparatus for applying sealing tape to a moving carton or other container to insure a proper seal without damage to the carton or the necessity of decreasing the speed of forward movement of the carton.

Another object of the present invention is to provide a method of applying sealing tape to a moving carton whereby the carton is firmly and expeditiously sealed without damage thereto.

These and other objects, features, and advantages of the present invention will be readily apparent from the following detailed description when read in conjunction with the accompanying drawings wherein like reference characters designate corresponding parts throughout the several views.

DESCRIPTION OF THE PREFERRED EMBODIMENT

Figure 1:
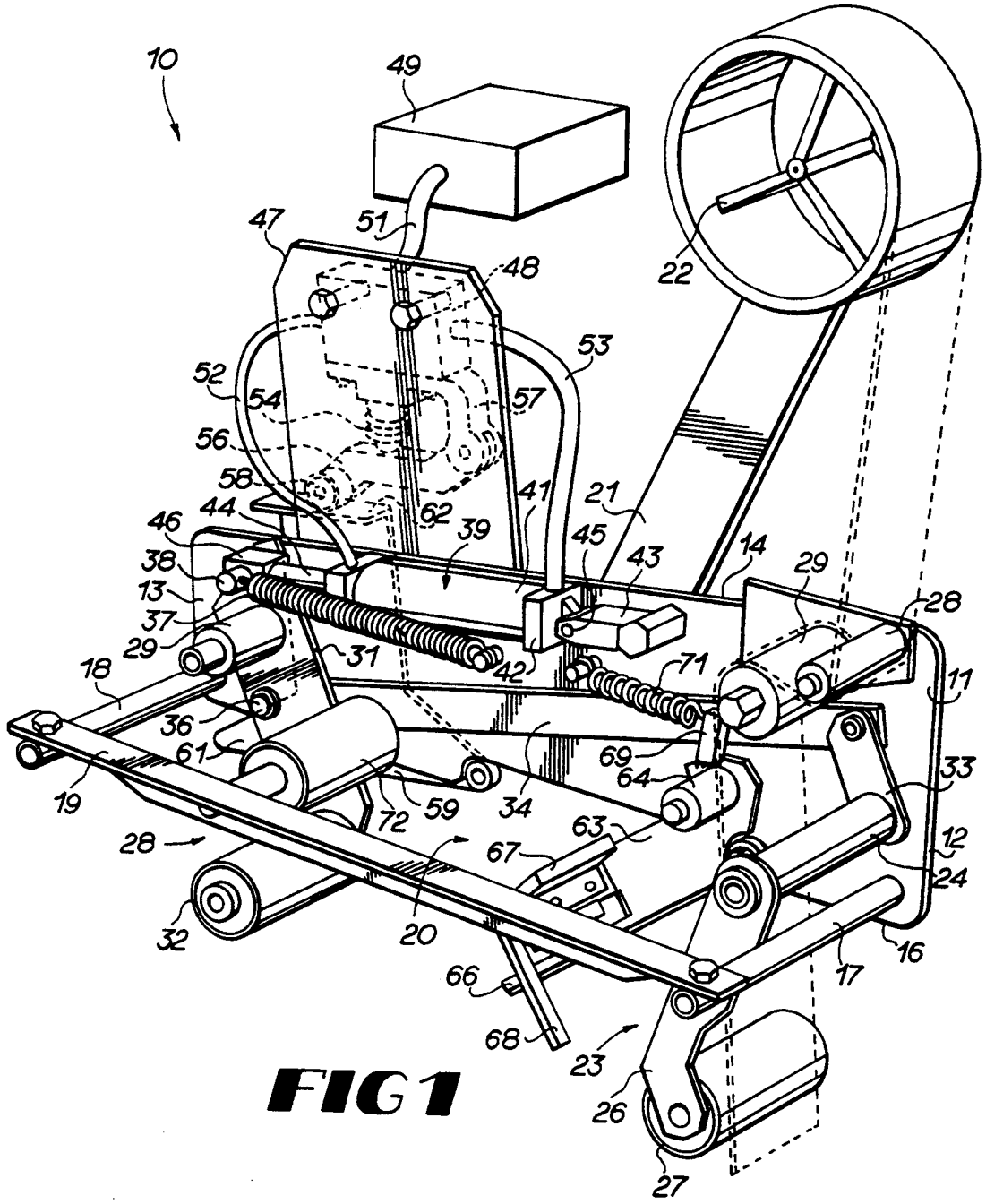
FIG. 1 is a perspective view of the preferred embodiment of the apparatus of the invention.

Referring now in detail to the preferred illustrative embodiment of the present invention as depicted in FIG. 1, a tape head 10 comprises a back plate 11 having front and rear ends 12 and 13 and upper and lower edges 14 and 16. A first rod 17 is affixed to and extends outwardly from back plate 11 adjacent the lower front corner thereof, and a second rod 18 is affixed to and extends outwardly from back plate 11 adjacent the lower rear corner thereof. The distal ends of rods 17 and 18 are joined by an elongated strip 19. The three structural members 17, 18 and 19 define an open area 20 adjacent to back plate 11 on one side thereof.

An elongated arm 21 is mounted to the other side of back plate 11 and extends upwardly above the tape head 10. A tape spool receiving member 22 is rotatably mounted to the upper end of arm 21 for holding a tape supply and paying out tape as shown in dashed lines.

A front roller assembly 23 is mounted to the back plate adjacent the front end 12 and comprises a pivot rod 24 rotatably mounted at its proximal end to back plate 11. Mounted to the distal end of rod 24 and affixed relative thereto is a roller support arm 26 which extends downwardly through the open space 20 defined by member 17, 18 and 19. A first or front tape roller 27 is rotatably mounted to the lower end of support arm 26. As can be seen in FIG. 1, a pair of rollers 28, 29 act to locate the tape strip so that it passes behind pivot rod 24 and structural rod 17, but in front of roller 27.

A rear roller assembly 28 is mounted to the back plate adjacent the rear end 13 thereof and comprises a pivot member 29 having its proximal end rotatably mounted to back plate 11. Attached to the same end of the pivot member 29 is a roller support arm 31 which extends down through the opening 20 and which has, at its lower end, a second tape roller 32 rotatably mounted to it. Front roller assembly 23 and rear roller assembly 28 are linked together by means of a crank 33 affixed at one end to the proximal end of pivot rod 24, and a linking rod 34 which is pivotally mounted at one end to the distal end of crank 33. The other end of rod 34 is pivotally mounted by suitable means 36 at a point on roller support arm 31 which is located between member 29 and roller 32. With such a linkage, when roller 27 is moved backward and upward upon being contacted by a moving carton, roller 32 is simultaneously moved forward and upward until both rollers 27 and 32 are in a retracted position, as will be explained more fully hereinafter.

In order for both rollers 27 and 32 to be in their extended position prior to being contacted by a carton, and further to cause the rollers 27 and 32 to apply pressure to the tape being applied to the carton, a biasing spring 37 is connected between rear roller assembly 28 and back plate 11. One end of spring 37 is connected to support arm 31 at a point which lies on the other side of pivot member 29 from means 36, as shown, by a suitable means such as pin 38 which is attached to arm 31. It can be seen that spring 37 pulls on pin 38, thus rotating arm 31 about pivot member 29 and forcing roller 32 down into its extended position. Simultaneously, because of the linkage between roller assemblies 23 and 28, roller 27 is also rotated down into its extended position.

As has been pointed out in the foregoing, the strength of spring 37 is deliberately chosen to be insufficient for causing roller 27 to resist the impact of the front or leading face of a carton to the extent where damage to the carton might occur. As a consequence, there is small likelihood that damage will be done to the front face during operation. However, and as will be more apparent hereinafter, it is highly desirable that roller 32 bear firmly against the rear or trailing face of the carton as it moves past the tape head 11. As a consequence, ideal operation of the tape head calls for a relatively weak bias force initially, which changes to a strong bias force during the sealing operation. In order that such a two-phase biasing force be realized in tape head 10, a cylinder and piston assembly 39 is mounted on back plate 11. One end 42 of the cylinder 41 is swivelly attached to a fixed clevis bracket 43 by means of pivot pin 45 and piston rod 44 extends from cylinder 41 with its distal end pivotally mounted to pin 38 by suitable means 46. Alternatively, the end of rod 44 may be attached to arm 31 independently of pin 38, but in any case, above pivot member 29. A valve support plate 47 extends upwardly from back plate 11, and a fluid control valve 48, shown in dashed lines, is mounted on the back or rear side of support plate 47. Valve 48 controls the flow of the piston and cylinder actuating fluid, which may be, for example, compressed air or hydraulic fluid, applied to valve 48 from a source 49 through a conduit 51. Valve 48, as shown in FIG. 1, can apply fluid to either end of cylinder 41 through conduits 52 and 53 to actuate piston 44 in either direction, or fluid may be applied only through conduit 52, in which case conduit 53 is unnecessary. When the fluid is applied to piston and valve assembly 29, piston and rod 44 retract into cylinder 41, thereby greatly increasing the force applied to arm 31 in the direction of the force of spring 37. A spring biased plunger 54 actuates valve 48, and is itself actuated by a movable arm 56 pivotally mounted to a fixed arm 57 on valve 48. The distal end of arm 56 has an actuating roller 58 mounted thereon.

Pivotally mounted on the lower edge 16 of back plate 11 is a valve actuating lever 59 having an extension member 61 and, at its upper end, an actuating surface 62 which bears against roller 58. The spring loaded plunger 54 maintains roller 58 in contact with surface 62, forcing lever 59 down into its extended position, as shown. As will be apparent hereinafter, when extension member 61 is forced upward by a carton being sealed, surface 62 forces roller 58, and hence arm 56 upward, thereby forcing plunger 54 upward and actuating valve 48.

A cutter arm 63 is pivotally mounted at its proximal end to back plate 11 by means of a pivot member 64. Arm 63 has an actuating finger 66 at its distal end, and a cutter assembly 67 is pivotally mounted on the distal end of arm 63. Cutter assembly 67 has a finger 68 extending therefrom, substantially at right angles to finger 66. Cutter assembly 67 may take any of a number of forms known in the art, that shown in FIG. 1 being by way of example. Cutter assembly 67 is pivotable relative to arm 63, and preferably is spring loaded to bias it to the position shown in FIG. 1. At the proximal end of arm 63 is a crank member 69 to which is attached one end of a biasing spring 71, the other end of which is attached to back plate 11. Spring 71 biases arm 63 and hence cutter assembly 67 into the down or extended position shown in FIG. 1.

In order that tape head 10 maintain a pressure on the tape being applied to a carton along the top surface thereof to insure a smooth application of the tape, an auxiliary roller 72 is rotatably mounted on member 19 between the front and rear rollers 27 and 32. Roller 72 is not spring biased, and may be eliminated if desired. On the other hand, it may be spring biased to bear against the tape along the top surface of the carton.

The operation of tape head 10 and the method of applying sealing tape to a moving carton is best seen and understood in FIGS. 2 through 7. For simplicity, and to avoid confusion, only those elements of tape head 10 involved in the particular operative steps illustrated have been identified by reference numerals.

Figure 2:
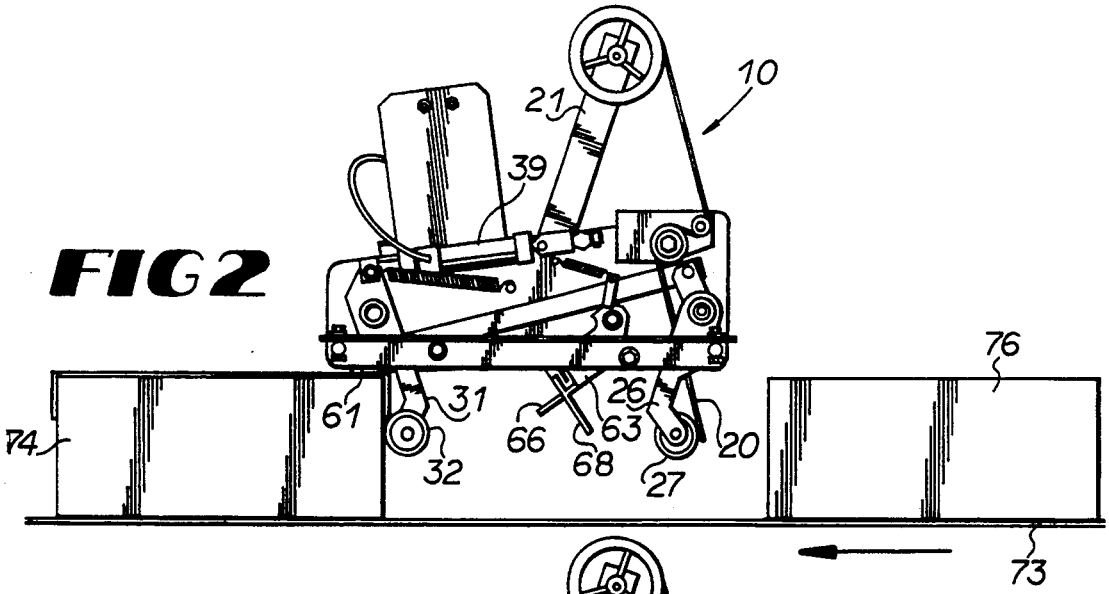
FIG. 2 through FIG. 7 are elevation views illustrating the sequence of steps of the method of the invention as performed by the apparatus of FIG. 1

In FIG. 2, tape head 10 is shown mounted above a conveyor 73 by any suitable means, not shown. Preferably the mounting means should include means for varying the distance of tape head 10 above the conveyor 73 so that cartons of different heights might be accommodated. In FIG. 2, a first carton 74 is leaving tape head 10 in the direction of the arrow as a second carton 76 is approaching contact with roller 27 and tape 20. Both roller support arms 26 and 31 in their extended position, as is cutter support arm 63, but extension member 61 is still in its retracted position, hence, cylinder and piston assembly 39 is still augmenting the force applied to arm 31. The spacing between cartons is such that member 61 releases just prior to carton 76 making contact with roller 27 and tape 20, allowing the pressure in cylinder 41 to bleed off, thereby removing the force applied by cylinder and piston assembly 39. Alternatively, where cylinder and piston assembly 39 is double acting, piston rod 44 is returned to its extended position.

Figure 3:
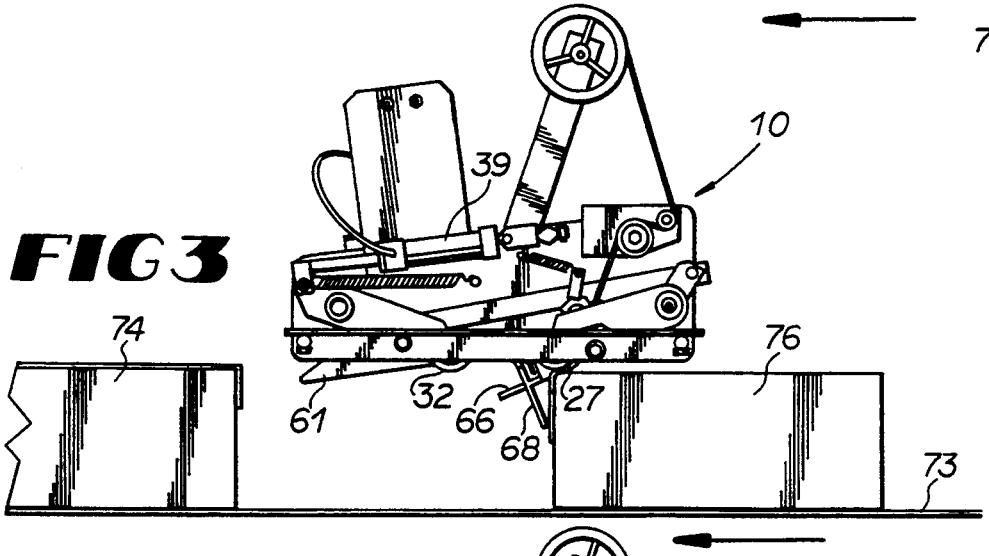

In FIG. 3, roller 27 has rolled up the leading face of carton 76, applying tape thereto, as carton 76 forces it toward its retraced position. Roller 32 is likewise forced up into its retraced position, while member 61 is in its extended position, as is cutter support arm 63 and cutter assembly 67. The tape 20 has been applied to the leading face of carton 76 and roller 27 is pressing the tape onto the front end of the top surface of carton 76.

Figure 4:
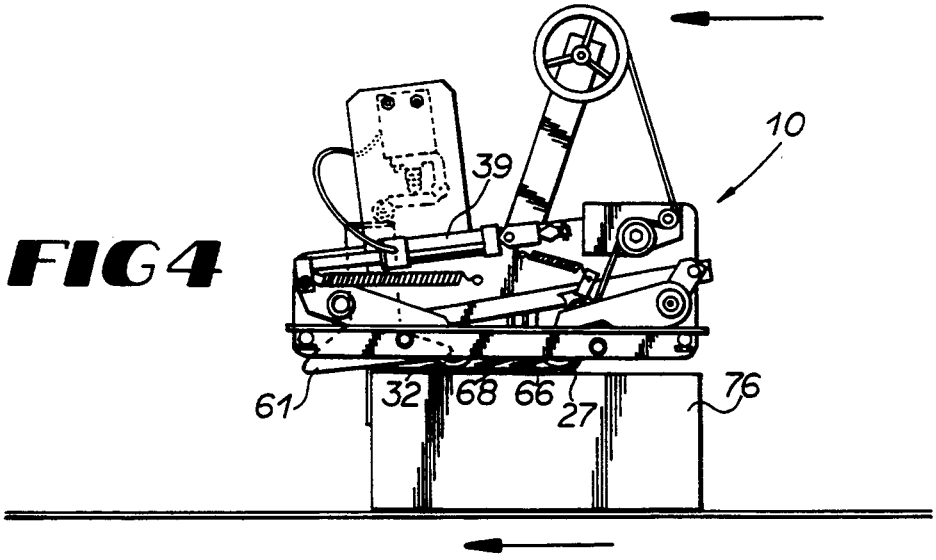
Figure 5:
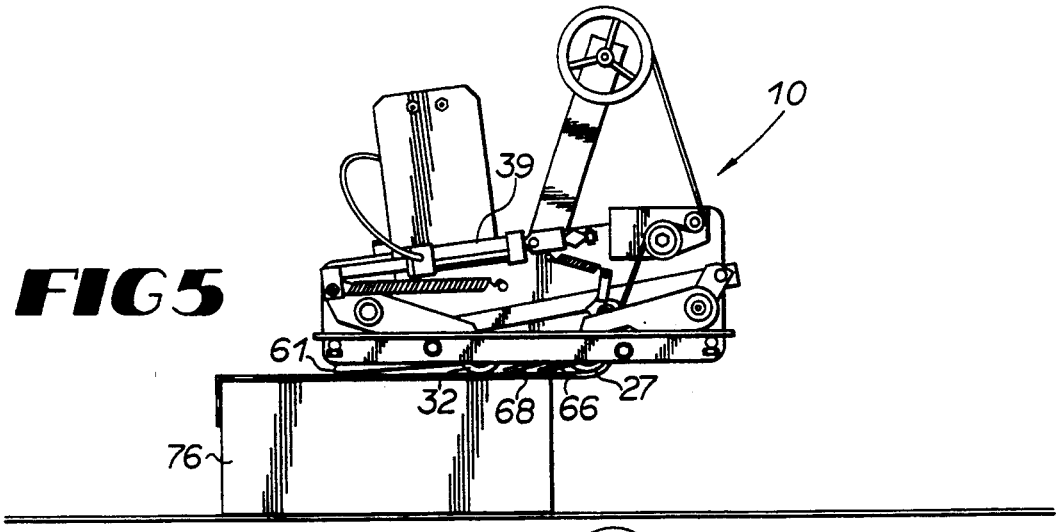

As shown in FIG. 4, as carton 76 continues to move under tape head 10, fingers 66 and 68 are both forced upward into their retracted positions, with finger 68 causing cutter assembly 67 to pivot relative to arm 63 as it aligns itself with finger 66. The tape is being rolled onto the top surface of carton 76 under pressure from rollers 27, 32, and roller 72 (not shown in FIG. 4) to insure uniform application thereof. In addition, extension member 61 has been cammed upward by the leading edge of the top surface of the carton 76, thereby actuating valve 48 and increasing the pressure of rollers 27 and 32 as explained hereinbefore. As the trailing edge of the top surface of carton 76 passes beyond roller 27, as shown in FIG. 5, both rollers 27 and 32 remain retraced, maintaining tape 20 under tension.

Figure 6:
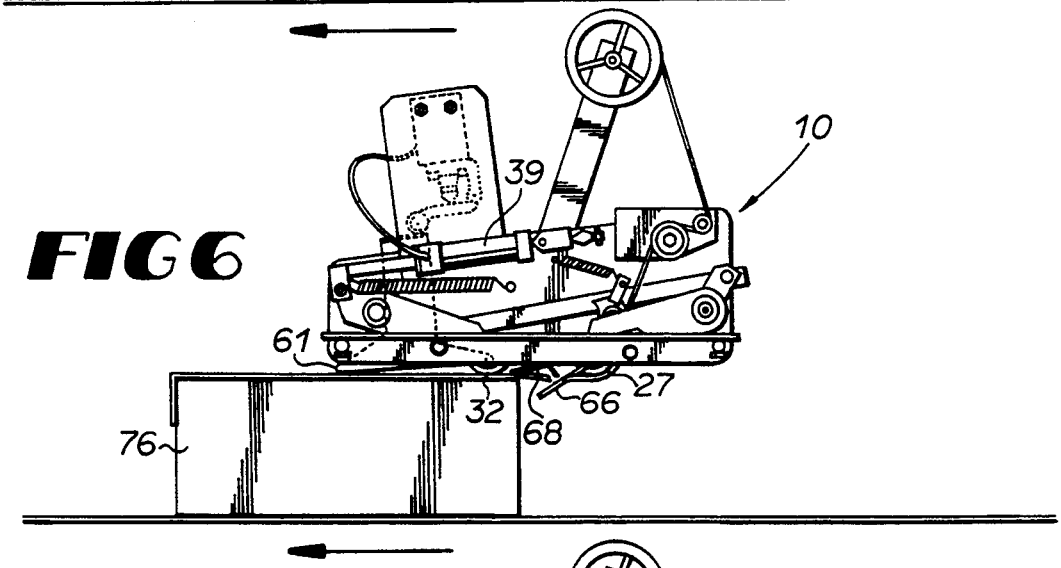
Figure 7:
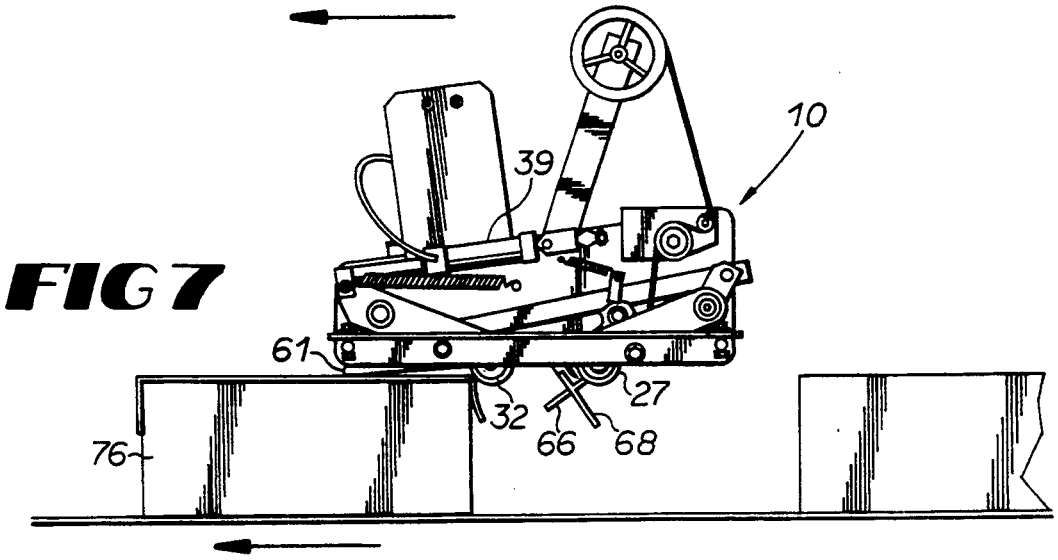

In FIG. 6, the trailing edge of carton 76 has passed beyond finger 66, and cutter support arm 63 commences to move down to its extended position, causing cutter assembly 67 to cut tape 20, leaving an end of tape 20 extending beyond the trailing edge. In FIG. 7, it can be seen that this end of tape 20 is applied to the trailing face of the carton 76 by roller 32 which is subjected to the force of spring 37 and cylinder and piston assembly 39 as it rolls down the trailing face of carton 76 toward its extended position, thereby completing the sealing cycle, as shown in FIG. 2.

From the foregoing, it can be seen that the tape head of the invention, as embodied in the apparatus of FIG. 1, and the method of producing a two phase pressure to the tape applying roller results in a carton that is sealed uniformly and without damage. The method and apparatus of the invention is so gentle and yet positive in taping and sealing the cartons that even empty cartons may be sealed in the same manner without being damaged. Although the tape head is shown in the preferred embodiment mounted beside a conveyor in a production environment, it can also be used for sealing cartons or other work pieces individually by manual manipulation thereof.

It will be obvious to those skilled in the art that many variations may be made to the embodiment here chosen for the purpose of illustrating the present invention without departure from the spirit and scope thereof.

I claim:

1. A taping apparatus for applying tape to cartons having front and rear faces and a top surface and moving relative to said apparatus comprising:

a support frame;

a first tape roller rotatably mounted on a first support arm pivotally mounted to said frame;

a second tape roller rotatably mounted on a second support arm pivotally mounted to said frame;

said support arms being movable between an extended position and a retracted position;

biasing means for forming said support arms toward their extended position;

dispensing means for dispensing tape to said first roller;

said first roller being adapted to apply tape to the front face and the top surface of the carton and maintain pressure thereon and said second roller being adapted to maintain pressure on the tape against the top surface and to apply tape to the rear face of the carton and maintain pressure thereon; and pressure means for augmenting the force of said biasing means after said second roller contacts the top surface of the carton having tape applied thereto by said first roller and for maintaining increased pressure on the tape on the rear face thereof.

2. A taping apparatus as claimed in claim 1 and further comprising:

cutting means mounted on said support frame for cutting the tape between said first and second rollers after the carton has passed beyond said first roller.

3. A taping apparatus as claimed in claim 1 wherein said pressure means comprises a fluid cylinder and piston assembly mounted between said frame and one of said first and second support arms.

4. A taping apparatus as claimed in claim 3 and further comprising:

linking means for linking said first and second support arms together.

5. A taping apparatus as claimed in claim 3 and further comprising:

actuating means pivotally mounted to said support frame for actuating said pressure means after the front face of the carton has passed beyond said first roller.

6. A taping apparatus as claimed in claim 5 and further comprising:

a fluid supply means mounted to said support frame for supplying fluid to said cylinder and piston assembly upon being actuated by said actuating means.

7. A taping apparatus as claimed in claim 6 wherein said fluid supply means comprises a valve member having an actuating plunger which bears against said actuating means.

8. A taping apparatus as claimed in claim 6 wherein said cylinder and piston assembly is pneumatically actuated.

9. A taping apparatus as claimed in claim 6 wherein said cylinder and piston assembly is hydraulically actuated.

10. A taping apparatus for applying tape sequentially and without interruption to the leading face, top surface, and trailing face of a carton moving with respect thereto, comprising:

a support frame;

a first pressure roller assembly movably mounted to said support frame;

a second pressure roller assembly movably mounted to said support frame;

means for supplying sealing tape to said first pressure roller;

said first and second pressure roller assemblies being movable between extended and retracted positions;

biasing means for biasing said roller assemblies toward their extended position; and pressure enhancing means for increasing the pressure of said rollers on the carton by augmenting the bias force of said biasing means after the leading face of the carton has passed beyond said first pressure roller assembly.

11. A taping apparatus as claimed in claim 10 and further including means for causing said first and second pressure rollers to move in unison between their extended and retracted positions.

12. A taping apparatus as claimed in claim 10 wherein said pressure enhancing means includes means for maintaining the increased pressure of the second pressure roller on the carton as the tape is applied to the trailing face thereof.

13. A taping apparatus as claimed in claim 10 wherein said pressure enhancing means comprises a cylinder and piston assembly mounted between said support frame and one of said roller assemblies.

14. A taping apparatus as claimed in claim 10 and further comprising:

tape cutting means for cutting the tape after it has been applied to the top surface of the carton and before it has been applied to the trailing face thereof.

15. A taping apparatus as claimed in claim 14 wherein said tape cutting means has an extended and a retraced position, and further including means for biasing said tape cutting means toward its extended position.

16. A method for applying sealing tape to a carton having a front face, a top surface, and a rear face comprising the steps of:

applying the sealing tape up the front face of the carton while maintaining a first pressure thereon;

applying the sealing tape along the top surface of the carton for a portion of the length thereof while maintaining said first pressure;

increasing the pressure on the tape and carton as the tape is applied to the remainder of the length of the top surface;

maintaining the increased pressure on the tape and carton as the tape is applied to the remainder of the length of the top surface; and maintaining the increased pressure on the tape and the carton as the tape is applied down the rear face of the carton.

17. The method for applying sealing tape as claimed in claim 16 and further including the step of cutting the tape after it has been applied to the top surface of the carton.

18. The method for applying sealing tape as claimed in claim 17 wherein the tape is cut at a point thereon beyond the rear end of the top surface of the carton to leave sufficient tape to apply to the rear face of the carton.

* * * * *